US010933433B2

(12) United States Patent
Gerhardt et al.

(10) Patent No.: US 10,933,433 B2
(45) Date of Patent: Mar. 2, 2021

(54) HAND-HELD HIGH-PRESSURE CLEANING MACHINE AND ADAPTER

(71) Applicant: Positec Power Tools (Suzhou) Co., Ltd., Suzhou (CN)

(72) Inventors: Graham Gerhardt, Suzhou (CN); Brandon Martin, Suzhou (CN); Thomas Duncan, Suzhou (CN)

(73) Assignee: Positec Power Tools (Suzhou) Co., Ltd., Suzhou (CN)

( * ) Notice: Subject to any disclaimer, the term of this patent is extended or adjusted under 35 U.S.C. 154(b) by 0 days.

(21) Appl. No.: 15/562,486

(22) PCT Filed: Sep. 20, 2017

(86) PCT No.: PCT/CN2017/102528
§ 371 (c)(1),
(2) Date: Sep. 28, 2017

(87) PCT Pub. No.: WO2018/166164
PCT Pub. Date: Sep. 20, 2018

(65) Prior Publication Data

US 2019/0388917 A1 Dec. 26, 2019

(30) Foreign Application Priority Data

Mar. 16, 2017 (CN) ..... 201710157329.2
Aug. 25, 2017 (CN) ..... 201710741553.6

(51) Int. Cl.
*B08B 3/02* (2006.01)
*B05B 9/08* (2006.01)

(52) U.S. Cl.
CPC ..... *B05B 9/0861* (2013.01); *B08B 3/026* (2013.01); *B08B 2203/0223* (2013.01)

(58) Field of Classification Search
None
See application file for complete search history.

(56) References Cited

U.S. PATENT DOCUMENTS 3,502,355 A * 3/1970 Demler, Sr. ..... F16L 47/04 285/110
3,632,046 A * 1/1972 Hengesbach ..... B05B 7/2424 239/318

(Continued)

FOREIGN PATENT DOCUMENTS

CN 2737468 Y 11/2005
CN 203184271 U 9/2013

(Continued)

OTHER PUBLICATIONS

English machine translation of DE102004049630.*

*Primary Examiner* — Levon J Shahinian
*Assistant Examiner* — Jason P Riggleman
(74) *Attorney, Agent, or Firm* — Dentons US LLP

(57) ABSTRACT

A hand-held high-pressure cleaning machine includes: a housing, having a handle for grasping; functional components, including a motor and a pump driven by the motor; and a liquid inlet, disposed on the housing and capable of being connected to an external water source by a water pipe. The hand-held high-pressure cleaning machine further includes an adapter suitable to be connected between the liquid inlet and a portable container, and is connected to the external water source by the water pipe or connected to the portable container by the adapter. In the present invention, the portable container configured to hold liquid is mounted to the hand-held high-pressure cleaning machine by using the adapter, so that it can be flexibly moved together with the hand-held high-pressure cleaning machine. The present invention further provides an adapter suitable to be connected between a portable container and a hand-held spraying device.

10 Claims, 3 Drawing Sheets

(56) References Cited

U.S. PATENT DOCUMENTS

| | | | | |
|---|---|---|---|---|
| 4,604,202 | A | 8/1986 | Movshovitz | |
| 5,595,345 | A * | 1/1997 | Chura | B05B 1/1636 239/312 |
| 2006/0226295 | A1 | 10/2006 | Gulick et al. | |
| 2016/0016207 | A1 | 1/2016 | Horie et al. | |
| 2016/0236217 | A1 | 8/2016 | Jenkins | |
| 2016/0296980 | A1 * | 10/2016 | Zheng | B08B 3/026 |

FOREIGN PATENT DOCUMENTS

| | | | |
|---|---|---|---|
| CN | 103355135 | A | 10/2013 |
| CN | 203620835 | U | 6/2014 |
| CN | 104785465 | A | 7/2015 |
| CN | 205570600 | U | 9/2016 |
| CN | 205659825 | U | 10/2016 |
| CN | 106914439 | A | 7/2017 |
| CN | 107061213 | A | 8/2017 |
| CN | 206535797 | U | 10/2017 |
| DE | 102004049630 | * | 4/2006 |
| DE | 102004049630 | A1 | 4/2006 |
| EP | 420473 | A1 | 4/1991 |
| EP | 949005 | A1 | 10/1999 |
| GB | 2407848 | A | 5/2005 |
| WO | 2010078700 | A1 | 7/2010 |
| WO | 2017017286 | A2 | 2/2017 |

* cited by examiner

HAND-HELD HIGH-PRESSURE CLEANING MACHINE AND ADAPTER

CROSS-REFERENCE TO RELATED APPLICATIONS

This is the United States National Phase of International Patent Application No. PCT/CN2017/102528, filed Sep. 20, 2017, which claims the priority benefit of Chinese Patent Application No. 201710741553.6, filed Aug. 25, 2017, and Chinese Patent Application No. 201710157329.2, filed Mar. 16, 2017. The entirety of each of the foregoing priority applications is hereby incorporated by reference herein.

FIELD OF THE DISCLOSURE

The present invention relates to the cleaning field, and in particular, to a hand-held high-pressure cleaning machine and an adapter applicable to the hand-held high-pressure cleaning machine.

BACKGROUND

Emergence of cleaning machines brings great convenience to people's life. The cleaning machines may be used to clean cars, doors and windows, roads in courtyards, and the like, and are efficient, safe, and convenient. The cleaning machine mainly includes a principal machine, a spray gun, and a connection tube. The principal machine includes a battery or a power cable, a pump, a motor, and the like. The connection tube connects the principal machine and the spray gun.

A large-scale cleaning machine currently applied in the industry cannot be flexibly moved due to a large volume and a heavy weight. A hand-held cleaning machine needs to be connected to an external water tank by using a connection tube so that it can be used only by moving the cleaning machine, and a moving distance of the cleaning machine is limited by the length of the connection tube between the cleaning machine and the water tank, which brings inconvenience to users.

SUMMARY

Based on this, it is necessary to provide a hand-held high-pressure cleaning machine that can not only use an external water source, but also be connected to a portable container.

A hand-held high-pressure cleaning machine, comprising: a housing, having a handle for grasping; functional components, comprising a motor and a pump driven by the motor which are disposed in the housing; and a liquid inlet, disposed on the housing and capable of being connected to an external water source by using a water pipe; the hand-held high-pressure cleaning machine further comprises an adapter suitable to be connected between the liquid inlet and a portable container, and the hand-held high-pressure cleaning machine is optionally connected to the external water source by using the water pipe or connected to the portable container by using the adapter.

In one of the embodiments, the adapter comprises an adapter body and a liquid conveying tube, the adapter body comprises a first connection portion, the first connection portion comprises a first connection end and a second connection end in communication with each other, the first connection end is connected to the liquid inlet, the second connection end is connected to an opening of the portable container, one end of the liquid conveying tube is connected to or integrally molded on the adapter body, and the other end of the liquid conveying tube is suitable to extend into the portable container.

In one of the embodiments, an internal thread thread-connected to the portable container is formed in the second connection end.

In one of the embodiments, the inner diameter of the second connection end is 28 mm.

In one of the embodiments, multiple protrusions are disposed on an outer wall of the second connection end, and the multiple protrusions are configured to provide a contact surface abutting against a hand of an operator to reduce torque of screwing the adapter.

In one of the embodiments, the liquid inlet is optionally connected to a connection head of the water pipe or the first connection end.

In one of the embodiments, a breather hole in communication with the portable container is formed on the adapter body.

In one of the embodiments, the hand-held high-pressure cleaning machine further comprises a filter washer disposed at the liquid inlet, the housing is provided with a mounting portion fitted to the adapter, and the filter washer is sealed and mounted in the mounting portion.

In one of the embodiments, the portable container is a common beverage bottle.

In one of the embodiments, the portable container is fitted to one end of the adapter, the hand-held high-pressure cleaning machine is fitted to the other end of the adapter, the portable container comprises a bottom surface supporting the portable container, and when the portable container is connected to the hand-held high-pressure cleaning machine by using the adapter, the center of gravity of the hand-held high-pressure cleaning machine falls within a range of the bottom surface of the portable container, and the hand-held high-pressure cleaning machine can be supported above the portable container.

Beneficial effects of the present invention are: The hand-held high-pressure cleaning machine is connected to a portable container by using an adapter, indicating that the high-pressure cleaning machine can not only be connected to an external water source by using a water pipe, but also be connected to the portable container by using the adapter, thereby increasing use scenario and scope of the hand-held high-pressure cleaning machine, and improving portability.

The present invention further provides an adapter connected between a hand-held spraying device and a portable container to improve convenience of moving the hand-held spraying device.

The adapter is suitable to be connected between a hand-held spraying device and a portable container, the adapter comprises an adapter body and a liquid conveying tube, the adapter body comprises a first connection portion, the first connection portion comprises a first connection end and a second connection end in communication with each other, the first connection end is configured to be connected to a liquid inlet of the hand-held spraying device, the second connection end is configured to be connected to an opening of the portable container, one end of the liquid conveying tube is connected to or integrally molded on the adapter body, and the other end of the liquid conveying tube is suitable to extend into the portable container.

In one of the embodiments, an internal thread thread-connected to the portable container is formed in the second connection end.

In one of the embodiments, the adapter body further comprises a second connection portion, the second connection portion is disposed in the first connection portion, and is in communication between the first connection end and the second connection end, and the liquid conveying tube is fixedly or detachably connected to or integrally molded on the second connection portion, and is suitable to extend into the portable container.

In one of the embodiments, a breather hole in communication with the portable container is formed on the adapter body.

In the present invention, the portable container configured to hold liquid is mounted to the hand-held spraying device by using the adapter, so that the portable container can be flexibly moved together with the hand-held spraying device, which is highly flexible and brings great convenience to a user to perform a short-time operation.

DETAILED DESCRIPTION

For ease of understanding the present invention, the following is to describe the present invention more comprehensively with reference to the related accompanying drawings. The accompanying drawings show preferred embodiments of the present invention. However, the present invention may be implemented in many different forms, and is not limited to the embodiments described herein. Oppositely, an objective of providing these embodiments is to make the disclosed content of the present invention clearer and more comprehensive.

It should be noted that when an element is referred to as being "fixed on" another element, it can be directly on another element or there may be an intervening element. When an element is regarded as being "connected to" another element, the element can be directly connected to another element or there may be an intervening element.

Unless otherwise defined, all the technologies and scientific terms used herein are the same as meanings generally understood by a person skilled in the art of the present invention. The terms used in the specification of the present invention are merely for describing the specific embodiments, and are not intended to limit the present invention. The term "and/or" used herein includes any and all combinations of one or more of related listed items.

Figure 1:
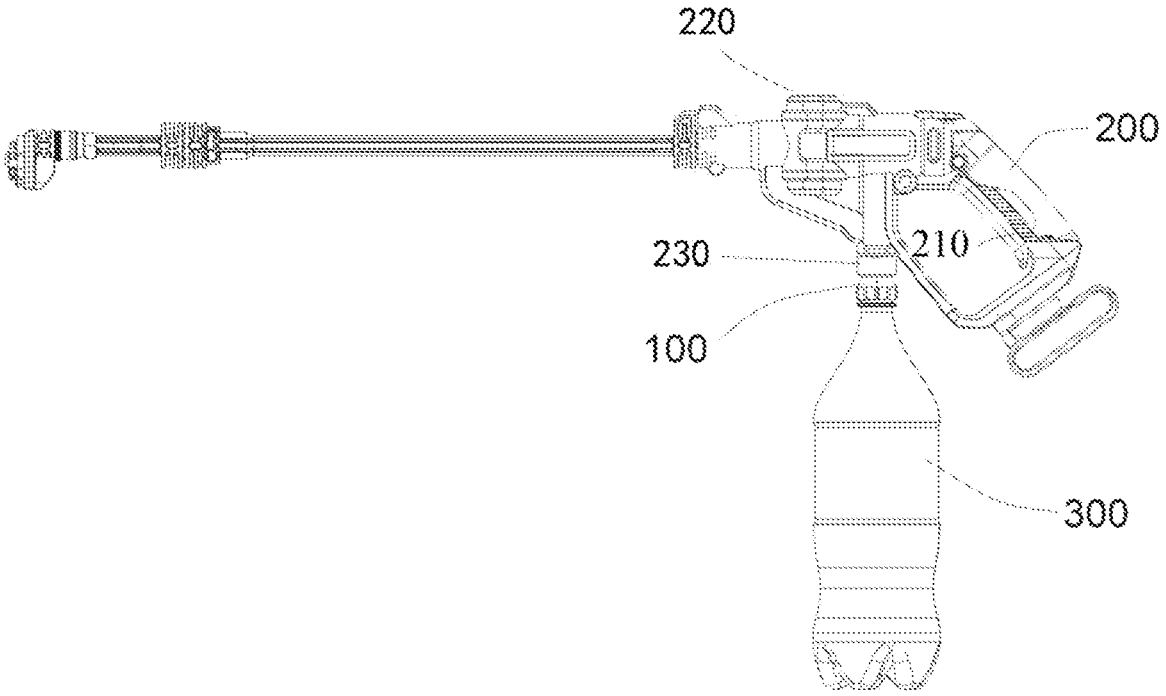
FIG. 1 is a schematic structural diagram of fitting a hand-held spraying device and a portable container by using an adapter in an embodiment of the present invention.

Referring to FIG. 1, in a preferred embodiment of the present invention, an adapter 100 is connected between a hand-held spraying device and a portable container 300, and is configured to mount the portable container 300 to the hand-held spraying device, so that the hand-held spraying device can pump out liquid held in the portable container 300. In this way, the portable container 300 configured to hold the liquid can be mounted to the hand-held spraying device by using the adapter 100, and the portable container 300 can be flexibly moved together with the hand-held spraying device, which is highly flexible and brings great convenience to a user to perform a short-time operation. In this specific embodiment, the portable container 300 is a bottle, for example, a soda bottle, a beverage bottle, or another household bottle, or may be a special bottle certainly. The liquid held in the portable container 300 is water, the hand-held spraying device is a hand-held high-pressure cleaning machine 200, and the adapter 100 is mounted between a bottle mouth and the hand-held spraying device, and is configured to pump out the water in the portable container 300 by using the hand-held spraying device, to clean objects.

It can be understood that in some other embodiments, the portable container 300 may be other utensils, for example, a case with one side open. The liquid held in the portable container 300 may be detergent, lube oil, or the like, and the adapter 100 is mounted between the open side of the case and the hand-held spraying device, and is configured to pump out the detergent or the lube oil in the portable container 300 by using the hand-held spraying device, to clean or lubricate objects. All of these are not limited herein.

Figure 2:
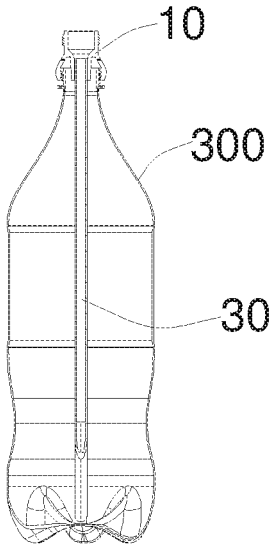
FIG. 2 is a sectional view that the adapter is fitted to the portable container shown in FIG. 1.

Referring to FIG. 2, specifically, the adapter 100 includes an adapter body 10 and a liquid conveying tube 30. The adapter body 10 is connected between the hand-held spraying device and the portable container 300, so as to mount the portable container 300 to the hand-held spraying device. The liquid conveying tube 30 is connected to or integrally molded on the adapter body 10, and another end of the liquid conveying tube 30 extends into the portable container 300 to enable the portable container 300 to be in communication with the hand-held spraying device, facilitating output of the liquid.

Figure 3:
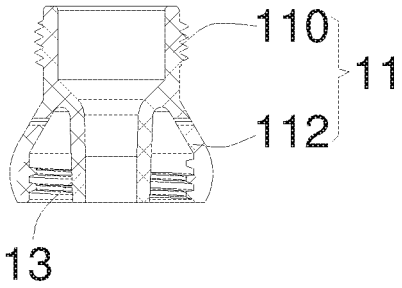
FIG. 3 is a sectional view of the adapter shown in FIG. 2.
Figure 4:
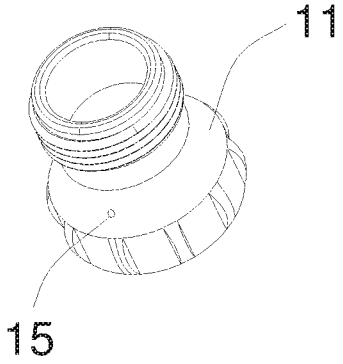
FIG. 4 is a schematic structural diagram of the adapter shown in FIG. 1.

Referring to FIG. 3, more specifically, the adapter body 10 includes a first connection portion 11, the first connection portion 11 includes a first connection end 110 and a second connection end 112 in communication with each other, the first connection end 110 is connected to the hand-held spraying device, and the second connection end 112 is connected to the portable container 300. In this embodiment, the first connection end 110 and the second connection end 112 are in communication with each other. In other embodiments, a barrier is disposed between the first connection end 110 and the second connection end 112, and piercing the barrier may enable the first connection end 110 and the second connection end 112 to be in communication with each other. In this specific embodiment, the first connection portion 11 is roughly in a shape of a hollow tube with two open ends, and the first connection end 110 and the second connection end 112 are two ends of the first connection portion 11 which are opposite to and in communication with each other. It can be understood that, in some other embodiments, the shape of the first connection portion 11 may be determined according to needs. Correspondingly, a position relationship between the first connection end 110 and the second connection end 112 may be determined according to needs. For example, the first connection end 110 and the second connection end 112 may be staggered but disposed in communication with each other, which is not limited herein.

Preferably, for ease of detaching and mounting of the adapter 100, the first connection portion 11 is detachably connected between the hand-held spraying device and the portable container 300. The detachable connection of the first connection portion 11 may be that the first connection end 110 is fixedly connected to the hand-held spraying device, and the second connection end 112 is detachably connected to the portable container 300; or that the first connection end 110 is detachably connected to the hand-held spraying device, and the second connection end 112 is fixedly connected to the portable container 300; or that the first connection end 110 and the second connection end 112 are detachably connected to the hand-held spraying device and the portable container 300 respectively.

In an embodiment, the first connection end 110 is connected to the hand-held spraying device by means of insertion, sleeving, or snap-on, and/or the second connection end 112 is connected to the portable container 300 by means of insertion, sleeving, or snap-on. When the second connection end 112 is mounted to the portable container 300 in an interference fit manner such as insertion or sleeving, and extends into the portable container 300, the liquid conveying tube 30 may be disposed on the second connection end 112, and extends into the portable container 300 together with the second connection end 112.

In an embodiment, the first connection end 110 is thread-connected to the hand-held spraying device, and/or the second connection end 112 is thread-connected to the portable container 300. When the second connection end 112 is mounted to the portable container 300 by threaded connection, and extends into the portable container 300, the liquid conveying tube 30 may be disposed on the second connection end 112, and extends into the portable container 300 together with the second connection end 112. In other embodiments, the liquid conveying tube 30 may be integrally molded on the second connection end 112, and one end of the liquid conveying tube 30 extends into the portable container. Specifically, an internal thread is disposed on an inner wall of the second connection end 112, the inner diameter of the second connection end is roughly 28 mm, the size of the inner diameter of the second connection end allows an error range of plus or minus 0.5 mm, and the thread depth of the internal thread is 2 mm, so as to match a cola bottle commonly seen on the market.

Preferably, multiple protrusions are disposed on an outer wall of the second connection end 112, and the multiple protrusions are configured to provide a contact surface abutting against fingers of an operator, so as to reduce torque of screwing the adapter. By means of the foregoing disposing, the operator can screw the adapter 100 and a liquid inlet with minimal force, and can detach the adapter 100 conveniently.

In this specific embodiment, the first connection portion 11 is roughly in a shape of a tube with two open ends, the first connection end 110 is roughly in a shape of a cylinder, and an external thread thread-connected to the hand-held spraying device is formed outside the first connection end 110; the second connection end 112 is in a shape of an inverted bowl matching the bottle mouth, and an internal thread thread-connected to an external thread of the bottle mouth is formed inside the second connection end 112. Therefore, the adapter 100 is in a shape of a bottle cap matching a bottle mouth of a common bottle. In this way, the user can clean a commonly used empty beverage bottle or the like to hold the required liquid, and connect the bottle to the hand-held spraying device by using the adapter 100, so as to spray out the liquid in the bottle by using the hand-held spraying device. The common beverage bottle can be flexibly moved due to a small volume, thereby bringing great convenience to the user to perform tasks such as short-time cleaning.

Further, the adapter body 10 further includes a second connection portion 13, the second connection portion 13 is disposed in the first connection portion 11 and is in communication between the first connection end 110 and the second connection end 112, and the liquid conveying tube 30 is fixedly or detachably connected to or is integrally molded on the second connection portion 13 and extends into the portable container 300, so as to be in communication between the hand-held spraying device and the portable container 300.

In this specific embodiment, the second connection portion 13 is in a shape of a hollow cylinder tube disposed in the first connection portion 11 and extending toward the second connection end 112 along an axial direction, and the liquid conveying tube 30 is fixedly or detachably sleeved on the tube-shaped second connection portion 13 and extends into the portable container 300, so as to be in communication between the hand-held spraying device and the portable container 300.

It can be understood that in some other embodiments, the second connection portion 13 may be a spacer plate formed in the first connection portion 11, a connection hole in communication with the first connection end 110 and the second connection end 112 is formed on the second connection portion 13, and one end of the liquid conveying tube 30 is fixedly or detachably inserted into the connection hole and is in communication between the hand-held spraying device and the portable container 300.

Preferably, a breather hole 15 in communication with the portable container 300 is formed on the adapter body 10 and is used to balance pressure inside and outside the portable container 300, to prevent the portable container 300 from being crushed due to extremely low air pressure inside the portable container 300.

The present invention further relates to a hand-held high-pressure cleaning machine 200 using the foregoing adapter 100. In this specific embodiment, the hand-held high-pressure cleaning machine 200 has a housing roughly in a shape of a pistol. The housing includes a handle 210 for grasping and a principal body 220 configured to store functional components. The principal body 220 includes a motor and a pump driven by the motor. In this embodiment, the handle 210 and the principal body 220 are disposed at an angle, and the hand-held high-pressure cleaning machine further includes a liquid inlet 230 disposed on the housing.

In this embodiment, the hand-held high-pressure cleaning machine 200 does not include a water tank, but is connected to a water pipe by using the liquid inlet 230, and then is connected to an external water source by using the water pipe. In this way, after the liquid inlet 230 is connected to the water pipe, during household activities, only a tail end of the water pipe needs to be connected to a tap, or put into a swimming pool, a pond, a bucket, or another external water source, so that the user can hold the high-pressure cleaning machine by hand and freely move within the length range of the water pipe to carry out spraying and cleaning work. During outdoor activities, the user only needs to stop at a place with water and put the tail end of the water pipe into an external water source to carry out spraying and cleaning work. The water in the external water source can be pumped into the high-pressure cleaning machine by the pump and then is directly sprayed out from a spray head. To improve portability, in this embodiment, the hand-held high-pressure cleaning machine 200 may also be connected to a portable container by using the adapter 100.

Figure 5:
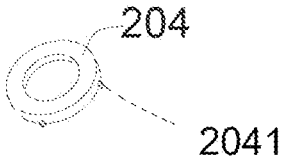
FIG. 5 is a schematic structural diagram of a filter washer in the hand-held spraying device shown in FIG. 1.

During mounting, the portable container 300 is fitted to one end of the adapter 100, the hand-held high-pressure cleaning machine 200 is fitted to the other end of the adapter 100 and is supported above the portable container 300. Therefore, no matter whether the portable container 300 holds liquid or not, the center of gravity of the hand-held high-pressure cleaning machine 200 is located within a supporting bottom surface of the portable container. In this way, the center of gravity of the hand-held high-pressure cleaning machine 200 is located on the portable container 300 when the hand-held high-pressure cleaning machine 200 is supported above the portable container 300, to balance the hand-held high-pressure cleaning machine 200. In addition, the adapter 100 is in communication with the liquid inlet, a nozzle is disposed on one end of a principal body 220 and is in communication with a liquid outlet, so as to spray out the liquid pumped in through the liquid inlet 230. Referring to FIG. 5, in an embodiment, the hand-held high-pressure cleaning machine 200 further includes a filter washer 204, a mounting portion fitted to the adapter 100 is disposed on the principal body 220, and the filter washer 204 is sealed and mounted in the mounting portion, and is located above the adapter 100. The filter washer 204 is made of an elastic material to ensure a sealed connection between the adapter 100 and the liquid inlet 230, so as to ensure that the hand-held high-pressure cleaning machine 200 successfully pumps out the liquid in the portable container 300. On the other hand, the filter washer 204 made of the elastic material converts a connection between the adapter 100 and the mounting portion to an elastic connection, to facilitate the detaching between the adapter 100 and the mounting portion.

In this specific embodiment, the water pipe includes a water pipe joint, the water pipe joint includes a connection head suitable to be connected to the liquid inlet 230, the connection head has a same connection structure as the first connection end 110, and the liquid inlet 230 is optionally connected to the connection head or the first connection end 110 of the adapter.

In this specific embodiment, bumps 2041 are formed on a peripheral surface of the filter washer 204, recesses (not shown) are formed at positions that are on the mounting portion 2010 and that are corresponding to the bumps 2041, thereby detachably mounting the filter washer 204 in the mounting portion 2010 by means of snap-fit between the bumps 2041 and the recesses. It can be understood that in some other embodiments, the fitting between the filter washer 204 and the mounting portion 2010 may be determined according to needs, which is not limited herein.

The following uses that the portable container 300 is a common beverage bottle (for example, a soda bottle or a cola bottle) as an example to describe in detail fitting between the adapter 100 and the hand-held high-pressure cleaning machine 200 and fitting between the adapter 100 and the common beverage bottle in the present invention.

During use, the common beverage bottle is filled with liquid required to be sprayed, the liquid conveying tube 30 is mounted on the second connection portion 13, the second connection end 112 of the first connection portion 11 of the adapter 100 is sleeved on and thread-connected to a bottle mouth of the common beverage bottle, the filter washer 204 is sealed and mounted in the mounting portion (not shown) of the hand-held high-pressure cleaning machine 200, and the first connection end 110 of the first connection portion 11 of the adapter 100 is sleeved and thread-connected in the mounting portion of the hand-held high-pressure cleaning machine 200, and is located below the filter washer 204. When operating, the user may carry the hand-held high-pressure cleaning machine 200 mounted with the common beverage bottle and walk to a place requiring spraying, to perform corresponding operations such as cleaning, which is highly flexible and convenient to move. Preferably, the common beverage bottle is a cola bottle, a sprite bottle, or the like. The inner diameter range (not including the wall thickness) of the second connection end 112 of the adapter 100 is 2 cm to 5 cm, and preferably, is 2.5 cm, 2.7 cm, 2.8 cm, or 3 cm.

For the operation of filling the common beverage bottle with the liquid, the liquid may be injected from the beverage bottle mouth, or a connection between the adapter 100 and the bottle mouth is unscrewed and the liquid may be injected from a gap between the two; or the liquid may directly introduced into the bottle from the first connection end 110 of the adapter 100 through the liquid conveying tube 30, without screwing the adapter 100, which is not limited herein.

In the present invention, the portable container 300 configured to hold the liquid is mounted to the hand-held high-pressure cleaning machine 200 by using the adapter 100, so that the portable container 300 may be flexibly moved together with the hand-held high-pressure cleaning machine 200, which is highly flexible and brings great convenience to the user to perform a short-time operation.

The embodiments described above merely show several implementations of the present invention, and are specifically described. However, it should not be construed as a limitation to the patent scope of the present invention. It should be noted that, a person of ordinary skill in the art may further make some variations and improvements without departing from the concept of the present invention, and the variations and improvements belong to the protection scope of the present invention. Therefore, the protection scope of the present invention shall be subject to the appended claims.

What is claimed is:

1. A hand-held pressure cleaning machine, comprising:

a housing, having a handle for grasping;

functional components, comprising a motor and a pump driven by the motor which are disposed in the housing; and a liquid inlet, disposed on the housing and capable of being connected to an external water source by using a water pipe, wherein the hand-held pressure cleaning machine further comprises an adapter suitable to be connected between the liquid inlet and a portable container, and wherein the hand-held pressure cleaning machine is connected to the external water source by using the water pipe connected to the liquid inlet or connected to the portable container by using the adapter, the adapter comprising:

an adapter body, wherein the adapter body comprises a first connection portion, the first connection portion comprising a first connection end and a second connection end in communication with each other, the first connection end configured to connect to the liquid inlet, the second connection end configured to connect to an opening of the portable container, and wherein the adapter body further comprises a second connection portion, the second connection portion being disposed on the inside of the first connection portion, and a cavity formed between the second connection end and the second connection portion, the cavity configured to receive the opening of the portable container.

2. The hand-held pressure cleaning machine according to claim 1, wherein the adapter further comprises a liquid conveying tube, one end of the liquid conveying tube being connected to or integrally molded on the adapter body or on the second connection portion, and the other end of the liquid conveying tube is suitable to extend into the portable container.

3. The hand-held pressure cleaning machine according to claim 2, wherein an internal thread thread-connected to the portable container is formed in the second connection end.

4. The hand-held pressure cleaning machine according to claim 3, wherein the inner diameter of the second connection end is 28 mm.

5. The hand-held pressure cleaning machine according to claim 3, wherein multiple protrusions are disposed on an outer wall of the second connection end, the multiple protrusions configured to provide a contact surface abutting against a hand of an operator to reduce torque of screwing the adapter.

6. The hand-held pressure cleaning machine according to claim 2, wherein the liquid inlet is connected to a connection head of the water pipe or the first connection end.

7. The hand-held pressure cleaning machine according to claim 2, wherein a breather hole in communication with the portable container is formed on the adapter body.

8. The hand-held pressure cleaning machine according to claim 1, wherein the hand-held pressure cleaning machine further comprises a filter washer disposed at the liquid inlet, the housing being provided with a mounting portion fitted to the adapter, and the filter washer is sealed and mounted in the mounting portion.

9. The hand-held pressure cleaning machine according to claim 1, wherein the portable container is a common beverage bottle.

10. The hand-held pressure cleaning machine according to claim 1, wherein the portable container is fitted to one end of the adapter, the hand-held pressure cleaning machine is fitted to the other end of the adapter, the portable container comprises a bottom surface supporting the portable container, and when the portable container is connected to the hand-held pressure cleaning machine by using the adapter, the center of gravity of the hand-held pressure cleaning machine is within the vertical space at or above the bottom surface of the portable container, and the hand-held pressure cleaning machine can be supported above the portable container.

* * * * *